United States Patent [19]

Lafever et al.

[11] Patent Number: 4,915,069

[45] Date of Patent: Apr. 10, 1990

[54] METERING VALVE STEM SEAL

[75] Inventors: Edward E. Lafever, Hagerstown; Kelly E. Duvall, Greensfork; Dean S. Bunce, Losantville, all of Ind.

[73] Assignee: Dana Corporation, Toledo, Ohio

[21] Appl. No.: 287,795

[22] Filed: Dec. 21, 1988

[51] Int. Cl.[4] ..... F16J 15/447; F01L 3/24; F01L 5/24; F01L 15/20

[52] U.S. Cl. ..... 123/188 P; 277/53; 277/203; 277/215

[58] Field of Search ..... 277/53, 167, 203, 215; 123/188 P

[56] References Cited

U.S. PATENT DOCUMENTS

| | | | |
|---|---|---|---|
| 1,775,403 | 9/1930 | McLeod . | |
| 1,868,668 | 7/1932 | Mahon . | |
| 2,821,973 | 2/1958 | Guhman . | |
| 3,243,240 | 3/1966 | Arthur . | |
| 3,330,605 | 7/1967 | Jasmand . | |
| 3,601,420 | 8/1971 | Binford . | |
| 3,942,336 | 3/1976 | Schultenkamper . | |
| 4,124,220 | 11/1978 | Leone et al. | 123/188 P X |
| 4,125,265 | 11/1978 | Grzesiak . | |
| 4,135,723 | 1/1979 | Urquhart | 277/203 |
| 4,763,618 | 8/1988 | Stritzke | 123/188 P |

FOREIGN PATENT DOCUMENTS

| | | | |
|---|---|---|---|
| 2753996 | 6/1979 | Fed. Rep. of Germany | 123/188 P |

*Primary Examiner*—Allan N. Shoap
*Attorney, Agent, or Firm*—F. B. McDonald

[57] ABSTRACT

A valve stem seal provides an elastomeric main valve body having an upper working portion and a lower support portion, the latter for support of the seal on a valve guide member. The seal contains a central helically threaded internal region adapted to meter oil flow betwen the valve guide and a valve stem reciprocally moveable with the guide. The upper working portion defines a pair of ends, wherein each end contains a non-threaded internal portion defining a plurality of alternately arranged axially extending grooves and ribs. The grooves provide oil flow passageways, while the ribs support the ends of the working portion against the reciprocal valve stem member. In a preferred form, the non-threaded internal portions have axial lengths within a range of one-tenth to one-third the axial length of the central threaded region.

10 Claims, 1 Drawing Sheet

METERING VALVE STEM SEAL

BACKGROUND OF THE INVENTION

This invention relates to valve stem seal assemblies utilized for controlling oil flow between valve stems and valve guide members of internal combustion engines. More particularly, this invention relates to mechanisms for enhancing the control or metering of such oil flow where at least a portion of the stem engaging surface of the seal assembly is threaded.

Internal combustion engines have pluralities of intake and exhaust valves, generally in a one-to-one relationship. Each valve comprises a head and an integral stem reciprocally mounted in a valve guide. Those skilled in the art will appreciate that there must be some oil flow along the stem in order to lubricate the latter as it reciprocates within the guide. As wear occurs in the valve guide and valve stem interface, oil flow will increase, causing excessive oil consumption and the formation of carbon deposits within the combustion chamber.

In order to reduce oil consumption and prevent carbon deposits, as well as to maintain engine performance, various designs have been developed to control or meter the oil flow between the stem and guide members. To the extent that relatively severe operating conditions occur in the exhaust as opposed to the intake valve areas, much effort has been directed to geometries of exhaust valve sealing media.

SUMMARY OF THE INVENTION

The valve stem seal of the present invention incorporates a geometry which enhances the metering of oil between valve stem and valve guide. The invention is particularly suitable for exhaust seal applications in internal combustion engines. In a preferred form, the valve stem seal has a main valve body which defines a pair of axially spaced extremities and a through passageway extending therebetween. A central helically threaded internal region is adapted to provide primary control of oil flow between the valve guide and stem. A pair of non-threaded ends define secondary internal portions which communicate with the central threaded internal region. Each non-threaded internal portion is comprised of a plurality of axially extending alternate ribs and grooves, wherein the grooves provide oil flow passageways leading to and exiting from the central threaded internal region. The ribs and grooves are spaced circumferentially about the non-threaded ends of the valve body, and militate against the tendency of the threads to collapse and thereby reduce oil flow over the useful life of the valve stem material. In a preferred form, each non-threaded internal portion extends axially approximately one-tenth to one-third of the axial length of the central threaded region. In addition, the threads of the central region may define a unitary, continuous spiral groove, or may comprise a plurality of parallel continuous spiral grooves, depending on the extent of oil flow metering desired.

DETAILED DESCRIPTION OF A PREFERRED EMBODIMENT

Figure 1:
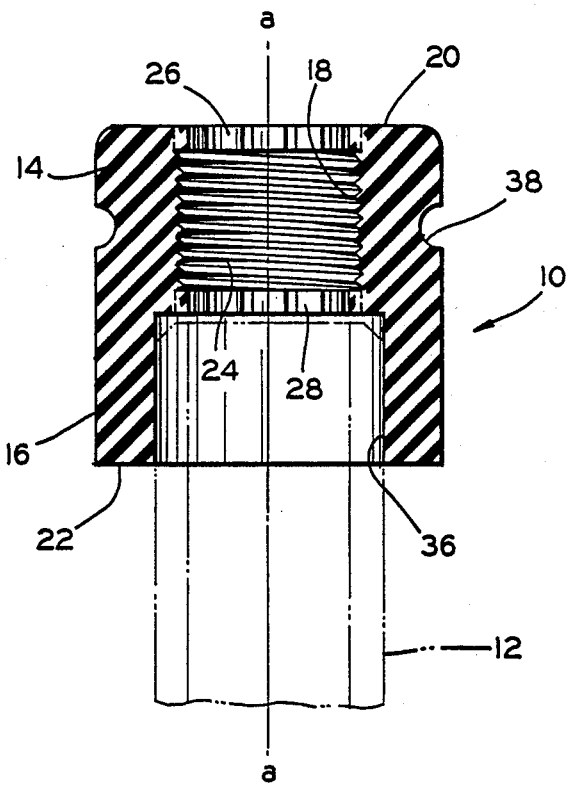
FIG. 1 is a cross sectional view of a preferred embodiment of a valve stem seal positioned atop a valve stem guide.

Referring initially to FIG. 1, valve stem seal 10 is adapted for being seated over a valve guide 12, as shown. The seal 10 defines a main valve body formed of a resilient, temperature resistant material, and includes an upper or working portion 14 and an integral lower skirt or support portion 16 which snugly engages the guide 12. In the preferred embodiment, the seal 10 is formed of a unitary, molded elastomeric material for desired resiliency and temperature resistance. The seal 10 includes a through passageway 1B adapted for receiving a valve stem 34 (shown in FIG. 2) which reciprocates under a continuously engaging contact with the working portion of the seal 14. The through passageway 18 extends from the upper extremity 20 of the seal 10 to the lower extremity 22 of the seal.

The working portion 14 of the seal incorporates a central helically threaded internal region 24 bounded by a non-threaded end portion 26 at the upper extremity 20 of the seal and a separate lower non-threaded end portion 28 at the bottom of the working portion 14.

Figure 3:
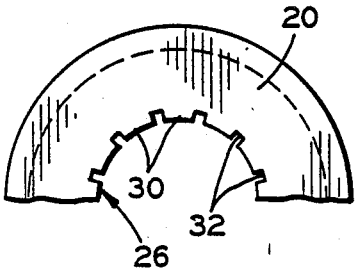
FIG. 3 is a top fragmentary view of the internal working portion of a valve stem seal constructed in accordance with the present invention, as would appear looking along the axis "a—a" of FIG. 1.

Referring now also to FIG. 3, the top non-threaded end portion 26 incorporates alternating ribs 30 and grooves 32 to provide positive flow of oil to and from the central helical threaded internal region 24. This structure enhances the controllability or metering of oil flow between the valve guide and valve stem, particularly critical under exhaust sealing conditions. In the preferred form, the axial length of each of the non-threaded end portions 26 and 28 (as measured along axis "a—a" of FIG. 1) falls within a range of one-tenth to one-third the axial length of the central threaded internal region 24.

In the preferred form, all ribs 30 have identical dimensions, as do all grooves 32 of a given seal 10. Referring now specifically to FIG. 3, the internal circumferential width of each groove 32 is approximately one-fifth that of each rib 30, as shown. However, in the practice of this invention, the relative groove-to-rib width ratio can be increased up to a value of approximately one, at which point the groove width becomes equal to that of the rib. A larger groove width ratio becomes less practical, however, to the extent that under the desired compressive loading against the valve stem 34, the ribs will tend to collapse.

Figure 2:
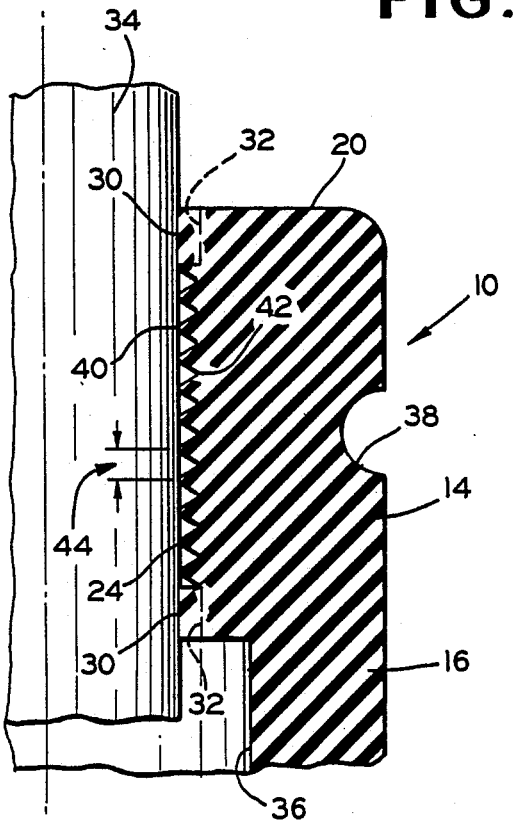
FIG. 2 is an enlarged cross sectional view of the valve stem seal of FIG. 1, shown interfacing with a reciprocally moveable stem.

The working portion 14 of the seal 10 contains the upper and lower combination of non-threaded end portions, as described, with the central threaded internal region between the end portions. Referring now particularly to FIG. 2, it will be appreciated by those skilled in the art that a valve stem 34 will interface reciprocally with the respective non-threaded and threaded surfaces of the working portion 14. The central threaded region 24 defines alternating peaks 40 and valleys 42, the valleys adapted for accommodating oil flow, the peaks adapted for maintaining continuous engagement with the reciprocating valve stem 34. In addition, the ribs 30 of the non-threaded end portions will maintain continuous contact with the valve stem, while the grooves 32 (FIG. 3) of the non-threaded end portions 26 and 28 will accommodate axial oil flow to and from the central threaded region 24. This invention therefore provides greater sealing control by effecting an improved metering of oil flow through the seal-stem interface.

In one preferred embodiment, the center-to-center distance between the ribs 30 will be approximately equal to the pitch width 44 as indicated in FIG. 2. The pitch width represents a thread measurement; the distance between either two adjacent valleys 42 or two adjacent peaks 40. In the preferred form, the peaks 40 of the threaded region 24 and the ribs 30 of the non-threaded ends 26 and 28 are adapted to continuously and simultaneously engage the valve stem 34 during reciprocal movement of the valve stem within the seal 10. For a seal 10 having an internal diameter in a range of 0.200 to 0.650 inch, both the rib height (as measured from bottom of an adjacent groove) and the thread depth (as measured radially from a valley to an adjacent peak) would fall within a range of three to ten thousandths of an inch. In a perferred form, the central threaded region 24 contains from 6 to 40 threads per inch.

It will be appreciated by those skilled in the art that the lower support portion 16 (FIG. 2), having a larger internal diameter 36 than that of the working portion 14, will depend from the upper working portion 14 for engagement of the valve guide 12. A peripheral annular groove 38 encircles the working portion 14 of the seal 10 and a spring ring retainer (not shown) may be suitably disposed within the groove 38 to compress the working portion 14 of the seal about the reciprocating shaft 34.

Finally, the central threaded internal region 24 as detailed and described herein comprises a single unitary continuous spiral groove. As it may be desirable to enhance oil flow under some conditions, this invention further contemplates use of a plurality of such continuous spiral grooves, formed parallel to one another.

The following claims envision the applicability of numerous other embodiments, not necessarily described herein, which may fall within the spirit and scope thereof.

What is claimed is:

1. In a valve stem seal having an annular main valve body defining an axis and adapted to sealingly engage a valve stem, said main body defining a pair of axially spaced extremities and a through passageway defining a central helically threaded internal region adapted to control oil flow between said valve body and said valve stem; an improvement comprising said threaded region being bounded by a non-threaded end portion comprising a plurality of axially extending ribs defining a plurality of axially oriented grooves, each groove comprising an oil flow passageway, each groove spaced circumferentially from the others about said internal valve body, each groove providing direct oil flow communication between said central threaded internal region of said through passageway and one of said pair of extremities of said main valve body, wherein said oil is metered through said seal by the combination of said grooves and said threaded region, said axially extending ribs supporting said threaded region against collapse and consequent reduction of oil flow through said valve body.

2. The valve stem seal of claim 1 wherein said main valve body comprises a unitary, molded, elastomeric material.

3. The valve stem seal of claim 2 wherein said central threaded region defines a cross section of peaks and valleys, wherein each valley is positioned between two peaks and each peak between two valleys, wherein said peaks of said threaded region and said ribs of said non-threaded end portions are adapted to simultaneously engage a valve stem during reciprocal movement of said valve stem within said seal.

4. The valve stem seal of claim 3 wherein at least one of said non-threaded end portions has an axial length within a range of one-tenth to one-third the axial length of said central threaded region.

5. The valve stem seal of claim 4 wherein said central threaded region and said non-threaded end portions together comprise an upper working portion of said main valve body, and wherein said seal further comprises a support portion comprising an adjacent and contiguous larger internal diameter depending from said upper working portion, said support portion adapted for affixation to a valve guide member.

6. The valve stem seal of claim 5 wherein said main valve body comprises a peripheral annular groove about said working portion of said body, said groove being adapted for receiving a spring ring retainer for compressing said working portion about said valve stem for enhancing sealability of said working portion with respect to said stem during reciprocal movement of said stem.

7. The valve stem seal of claim 6 wherein each of said axially extending ribs of each non-threaded end portion is positioned between two grooves, and each groove is positioned between two ribs, wherein the spacing between centers of said ribs is equal to one pitch width of said central threaded region.

8. The valve stem seal of claim 7 wherein said central threaded region comprises 6–40 threads per inch.

9. The valve stem seal of claim 8 wherein said central threaded region comprises a single unitary continuous spiral groove.

10. The valve stem seal of claim 8 wherein said central threaded region comprises a plurality of parallel continuous spiral grooves.

* * * * *